US011276380B2

(12) United States Patent
Sato et al.

(10) Patent No.: US 11,276,380 B2
(45) Date of Patent: Mar. 15, 2022

(54) HI-HAT ATTACHMENT

(71) Applicant: HOSHINO GAKKI CO., LTD., Aichi (JP)

(72) Inventors: Naoki Sato, Nagoya (JP); Masahiro Shimada, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 0 days.

(21) Appl. No.: 16/803,903

(22) Filed: Feb. 27, 2020

(65) Prior Publication Data

US 2021/0166664 A1 Jun. 3, 2021

(30) Foreign Application Priority Data

Nov. 28, 2019 (JP) ..... JP2019-215040

(51) Int. Cl.
*G10D 13/065* (2020.01)

(52) U.S. Cl.
CPC ..... *G10D 13/065* (2013.01)

(58) Field of Classification Search
CPC ..... G10D 13/065
USPC ..... 84/422.3
See application file for complete search history.

(56) References Cited

U.S. PATENT DOCUMENTS 4,497,092 A * 2/1985 Hoshino ..... F16B 7/1418 24/271
4,528,888 A * 7/1985 Hoshino ..... G10D 13/065 84/402
4,928,567 A * 5/1990 Kurosaki ..... G10D 13/065 84/421
5,438,903 A * 8/1995 Cropek ..... G10D 13/11 84/422.3
5,668,332 A * 9/1997 Lombardi ..... G10D 13/065 84/422.3
6,054,645 A * 4/2000 Gauger ..... G10D 13/065 84/411 R
6,177,621 B1 * 1/2001 Hoshino ..... G10D 13/065 84/421
7,126,050 B1 * 10/2006 Lombardi ..... G10D 13/065 84/422.1
7,671,263 B1 * 3/2010 Coady ..... G10D 13/065 84/422.3
8,476,515 B2 * 7/2013 Coady ..... G10D 13/065 84/422.3
8,569,604 B1 * 10/2013 Sikra ..... G10D 13/065 84/422.4
8,692,098 B1 * 4/2014 Reinhard ..... G10D 13/065 84/422.3
8,822,798 B1 * 9/2014 Martin ..... G10D 13/065 84/422.3
9,601,096 B2 * 3/2017 Sikra ..... F16B 39/32
2006/0243117 A1 * 11/2006 O'Donnell ..... G10D 13/065 84/422.3
2011/0167985 A1 * 7/2011 Holland ..... G10D 13/065 84/422.3
2016/0284328 A1 * 9/2016 Sera ..... G10D 13/065
2021/0166664 A1 * 6/2021 Sato ..... G10D 13/28

* cited by examiner

*Primary Examiner* — Christina M Schreiber

(57) ABSTRACT

The hi-hat attachment includes an upper unit, a lower unit, and an operation lever. The lower unit includes a regulation unit that regulates the maximum fall position of the lower unit. The regulation unit is configured to adjust the maximum fall position of the lower unit.

7 Claims, 11 Drawing Sheets

HI-HAT ATTACHMENT

BACKGROUND

1. Field

The present invention relates to a hi-hat attachment for attaching a hi-hat to a hi-hat stand.

2. Description of Related Art

A way of playing the hi-hat includes hitting the hi-hat in a half-open state by slightly returning the pedal from a state in which the pedal is deeply depressed. In this case, the hi-hat is in an intermediate state between the closed state and the open state, and can make a sound in which the top cymbal and the bottom cymbal touch lightly. Further, the player can change the tone and sound of the hi-hat by adjusting the amount of depression of the pedal and adjusting the degree of the half-opening of the hi-hat.

On the other hand, there is a drum set that is set so that two single pedals are operated to strike two bass drums. There is also a drum set that is set so that a twin pedal is operated to strike a bass drum. When performing with these drum sets, the player have to operate the hi-hat stand pedal while operating the bass drum pedal with two feet.

However, the player cannot depress the pedal of the hi-hat stand and the two pedals of the bass drum simultaneously. Therefore, while playing the bass drum with two pedals, the top cymbal is completely away from the bottom cymbal, and the hi-hat is in an open state. Therefore, there has been proposed a hi-hat attachment configured to switch an open state of the hi-hat by hitting an operation lever with a drum stick.

For example, a hi-hat attachment disclosed in U.S. Pat. No. 4,928,567 includes a fixed portion fixed to the rod of the hi-hat stand, an operation lever turnably connected to the fixed portion, and a cymbal holding portion disposed below the fixed portion. The cymbal holding portion is slidably supported on the rod while holding the top cymbal. A hook is provided at a lower end of the operation lever to engage with an upper step of the cymbal holding portion. This hi-hat attachment is configured such that when the operation lever is hit from above with a drum stick, the operation lever turns, the hook of the operation lever is disengaged from the upper step of the cymbal holding portion.

When the hook of the operation lever is disengaged from the upper step of the cymbal holding portion, the cymbal holding portion falls from the initial position together with the top cymbal. As a result, since the top cymbal contacts the bottom cymbal, the hi-hat is switched from the open state to the closed state. Further, when the pedal of the hi-hat stand is depressed, the operation lever is lowered together with the rod, and the hook of the operation lever is engaged with the upper step of the cymbal holding portion. Then, by releasing the depression of the pedal, the cymbal holding portion is lifted together with the top cymbal from the fall position to the initial position. As a result, the hi-hat is switched from the closed state to the open state.

However, in the hi-hat attachment disclosed in this document, because the top cymbal falls by its own weight and contacts the bottom cymbal, the hi-hat can be switched only from open state to closed state. Therefore, it is not possible to resonate the sound when the hi-hat is half-opened. Thus, as disclosed in U.S. 2011/0167985 A, the hi-hat attachment has been proposed in which the hi-hat can be switched between three types of open state, half-open state, and closed state.

The hi-hat attachment disclosed in U.S. 2011/0167985 A includes a fixed portion fixed to the rod of the hi-hat stand, a pair of left and right operation levers turnably connected to the fixed portion, and a cymbal holding portion disposed below the fixed portion. The cymbal holding portion is slidably supported on the rod while holding the top cymbal. Each operation lever has a first leg extending horizontally, a second leg extending downward from an end of the first arm, and a hook provided at a distal end of the second leg. The second leg of the left operation lever is longer than the second leg of the right operation lever and extends below the hook of the right operation lever.

In the hi-hat attachment disclosed in this document, when the first leg of the right operation lever is hit from above with a drum stick, the hook of the right operation lever is disengaged from the upper step of the cymbal holding portion. Then, the cymbal holding portion falls from the initial position together with the top cymbal. When the hook of the left operation lever is engaged with the upper step of the cymbal holding portion, the fall of the cymbal holding portion and the top cymbal stops at the intermediate position. As a result, the hi-hat is switched from the open state to the half-open state.

Next, when hitting the first leg of the left operation lever with a drum stick from above, the hook of the left operation lever comes off the upper step of the cymbal holding portion, and the cymbal holding portion falls further together with the top cymbal from the intermediate position. As a result, since the top cymbal contacts the bottom cymbal, the hi-hat is switched from the half-open state to the closed state. In this way, in the hi-hat attachment disclosed in U.S. 2011/0167985 A, the hi-hat can be switched between an open state, a half-open state, and a closed state by hitting the right operation lever and the left operation lever sequentially with a drum stick.

However, in the hi-hat attachment disclosed in U.S. 2011/0167985 A, the right operation lever and a connection tool for connecting the right operation lever to the fixed portion are added in order to realize a configuration that makes the hi-hat in a half-open state. For this reason, the number of components of the hi-hat attachment increases, and the configuration of the entire hi-hat attachment becomes complicated. Also, when the hi-hat is switched between the open state, the half-open state, and the closed state, it is necessary to hit the right operation lever and the left operation lever with the drum stick in this order, and thus, the switching operation is complicated.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a hi-hat attachment for attaching a hi-hat to a hi-hat stand is provided. The hi-hat includes a top cymbal and a bottom cymbal. The hi-hat stand includes a pedal operated during performance of the hi-hat, and a rod that moves up and down when the pedal is depressed. The hi-hat attachment includes a fixed portion configured to be fixed to the rod, a cymbal holding portion configured to be slidably supported on the rod, the cymbal holding portion being configured to hold the top cymbal below the fixed portion, and an operation lever provided on one of the fixed portion and the cymbal holding portion, the operation lever being configured to be engageable with the other of the fixed portion and the cymbal holding portion. The hi-hat attachment is configured such that, while the cymbal holding portion is disposed at an initial position and the hi-hat is in an open state when the operation lever and the fixed portion or the cymbal holding portion are engaged, the cymbal holding portion falls when an engagement between the operation lever and the fixed portion or the cymbal holding portion is released. The hi-hat attachment includes a regulation unit configured to regulate a maximum fall position of the cymbal holding portion.

In another general aspect, a hi-hat attachment for attaching a hi-hat to a hi-hat stand is provided. The hi-hat includes a top cymbal and a bottom cymbal. The hi-hat stand includes a pedal operated during performance of the hi-hat, and a rod that moves up and down when the pedal is depressed. The hi-hat attachment includes a fixed portion configured to be fixed to the rod, a cymbal holding portion configured to be slidably supported on the rod, the cymbal holding portion being configured to hold the top cymbal below the fixed portion, and an operation lever provided on one of the fixed portion and the cymbal holding portion, the operation lever being configured to be engageable with the other of the fixed portion and the cymbal holding portion. The hi-hat attachment is configured such that, while the cymbal holding portion is disposed at an initial position and the hi-hat is in an open state when the operation lever and the fixed portion or the cymbal holding portion are engaged, the cymbal holding portion falls when an engagement between the operation lever and the fixed portion or the cymbal holding portion is released. The operation lever has a hitting surface that is hit by a tool for releasing an engagement with the fixed portion or the cymbal holding portion. The hitting surface extends downward and away from a horizontal line orthogonal to the axis of the rod as the hitting surface is away from the axis of the rod.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

Hereinafter, an embodiment of a hi-hat attachment 10 of the present invention will be described with reference to FIGS. 1 to 9.

Figure 1:
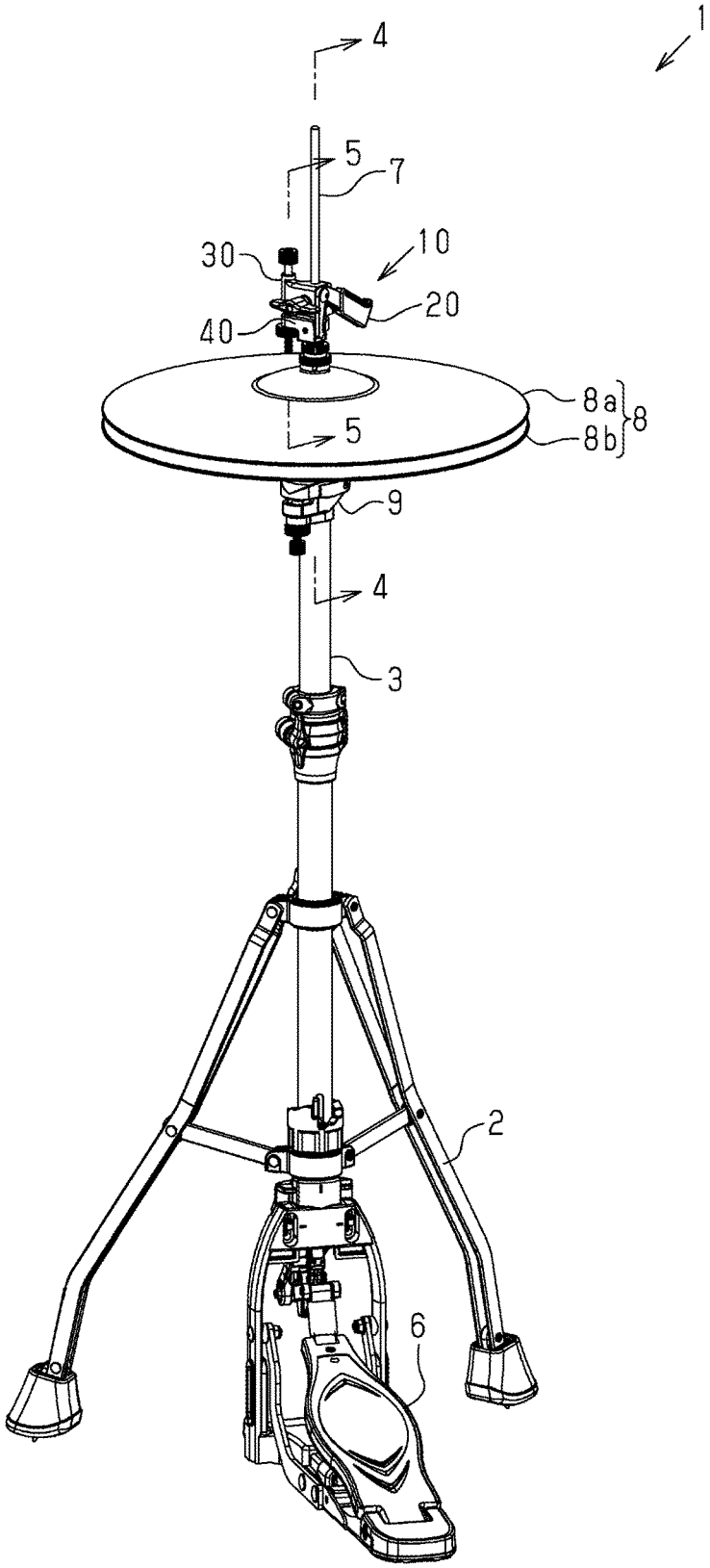
FIG. 1 is a perspective view showing the overall configuration of a hi-hat stand to which a hi-hat is attached using a hi-hat attachment according to an embodiment of the present invention.

As shown in FIG. 1, a hi-hat stand 1 includes a stand body 3 having legs 2, a pedal 6 fixed to the lower end of the stand body 3, and a rod 7 inserted into the inside of the stand body 3. The rod 7 moves downward by a depression of the pedal 6, and moves upward by releasing the depression. A hi-hat 8 includes a top cymbal 8*a* and a bottom cymbal 8*b*. The bottom cymbal 8*b* is supported from below by an upper end of the stand body 3 via a support 9. The top cymbal 8*a* is attached to the vicinity of the upper end of the rod 7 using a hi-hat attachment 10.

The hi-hat attachment 10 includes an upper unit 30 as a fixed portion fixed to the rod 7, a lower unit 40 slidably supported on the rod 7, and an operation lever 20 provided on the upper unit 30. The lower unit 40 functions as a cymbal holding portion that holds the top cymbal 8*a* below the upper unit 30. The hi-hat attachment 10 is configured so that the hi-hat 8 can be switched from an open state to a half-open state by hitting the operation lever 20 with a drum stick from above. The operation lever 20 is set on the right side of the rod 7 so that the player can easily hit the operation lever 20 with the drum stick.

Figure 2:
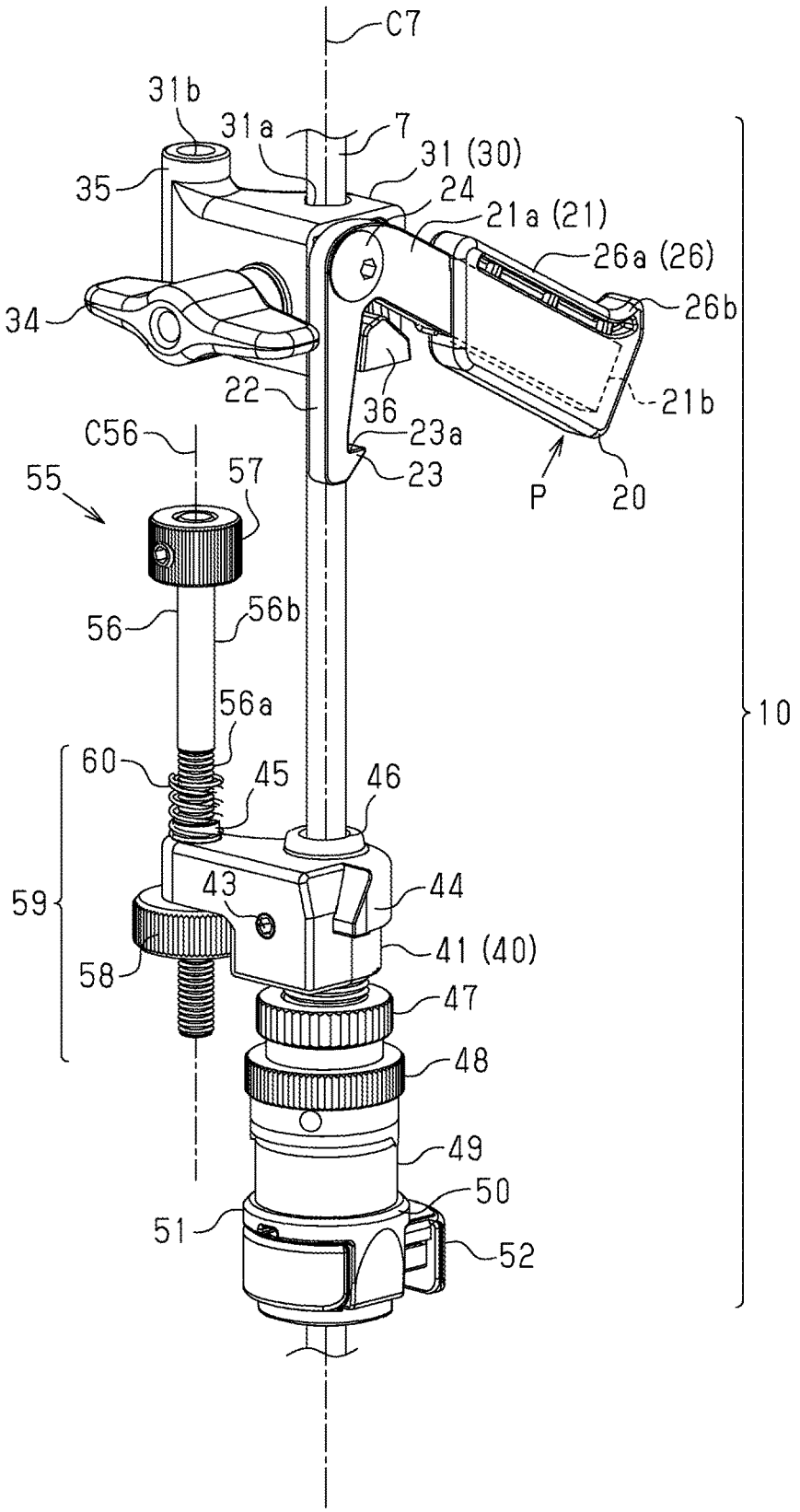
FIG. 2 is a perspective view showing the entire configuration of the hi-hat attachment.
Figure 3:
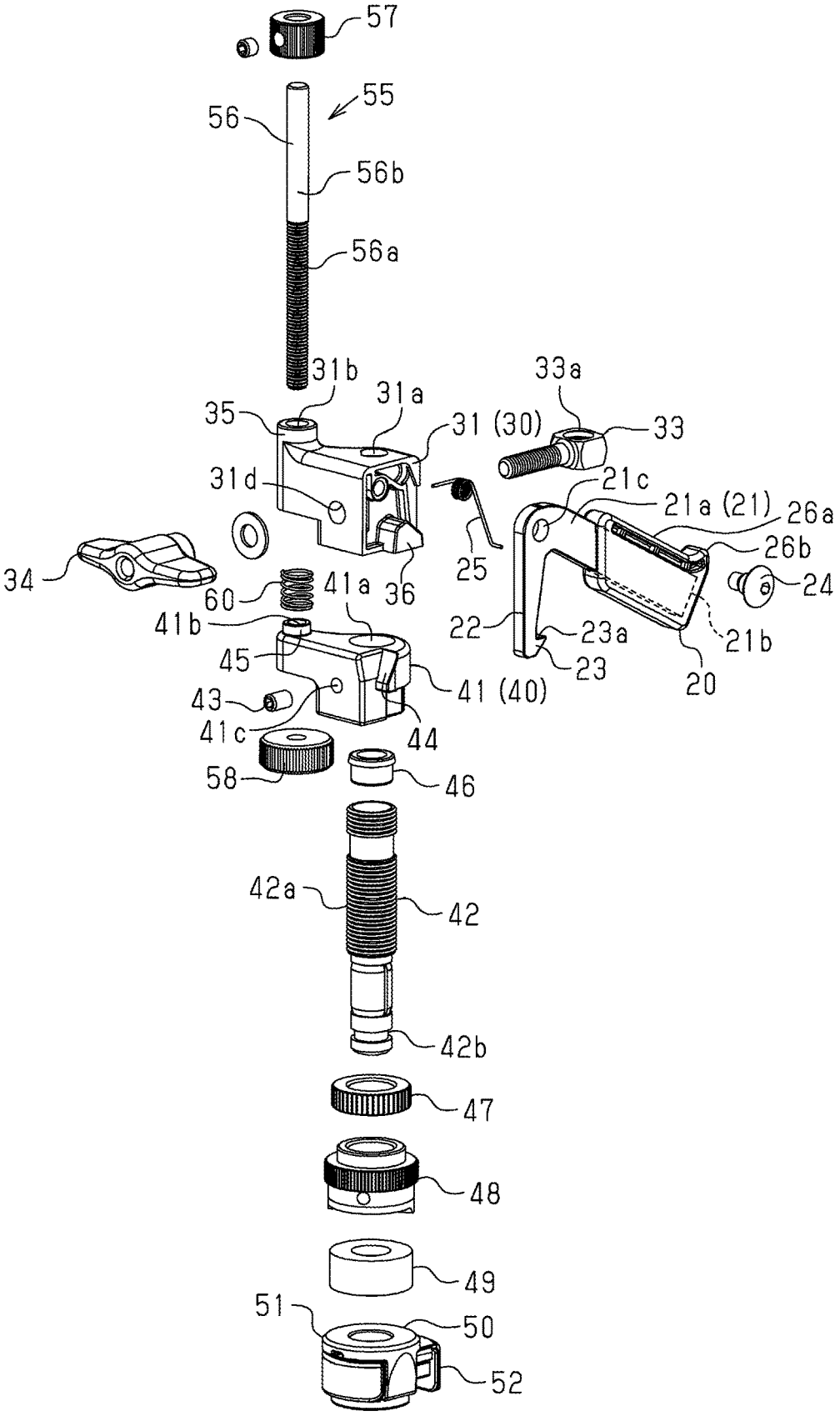
FIG. 3 is an exploded perspective view of the hi-hat attachment.

As shown in FIGS. 2 and 3, the operation lever 20 includes a lever portion 21, an arm portion 22, and a hook portion 23, and is formed in a substantially L shape. The lever portion 21 has a lever proximal end 21*a* close to the axis of the rod 7 and a lever distal end 21*b* away from the axis of the rod 7. The lever proximal end 21*a* has an insertion hole 21*c* through which a mounting screw 24 is inserted. The operation lever 20 together with a torsion spring 25 is attached to the upper part of the upper unit 30 from the side by the mounting screw 24. The operation lever 20 is turnably connected to the upper unit 30 around the mounting screw 24. The torsion spring 25, while attached to the upper unit 30, biases the operation lever 20 in a direction for turning the operation lever 20 counterclockwise as indicated by the arrow P in FIG. 2.

Figure 7:
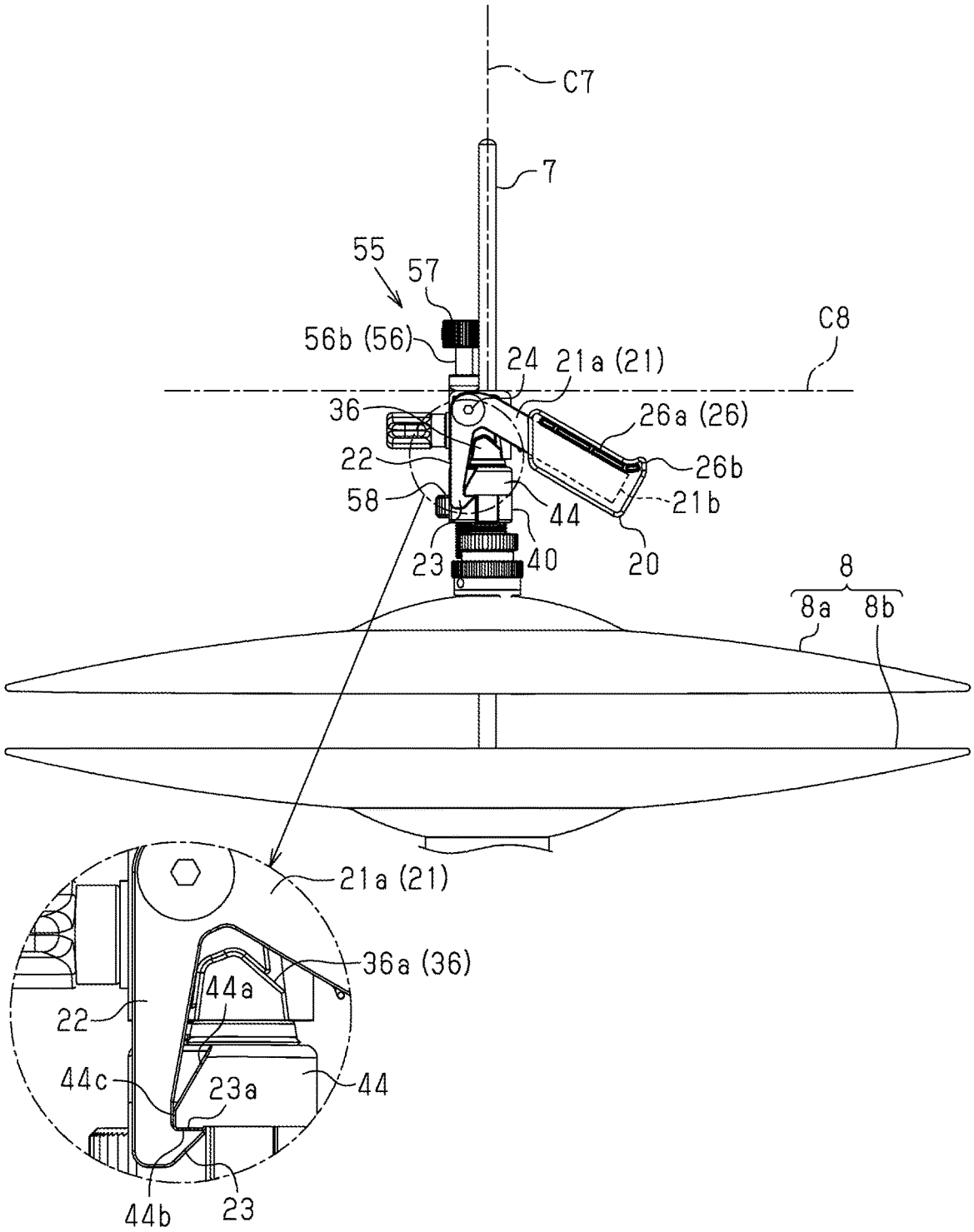
FIG. 7 is a partial side view showing a state where the hi-hat is in an open state.

As shown in FIG. 7, the lever portion 21 extends downward and away from the horizontal line C8 orthogonal to the axis C7 as the lever portion 21 is away from the axis C7 of the rod 7. That is, the lever portion 21 extends obliquely downward from the vicinity of the rod 7. A substantially rectangular parallelepiped cushion rubber 26 having substantially the same shape as the lever portion 21 is attached to the lever distal end 21*b*. The upper side surface 26*a* of the cushion rubber 26 is used as a hitting surface hit by the drum stick.

Similarly to the lever portion 21, the upper side surface 26*a* of the cushion rubber 26 also extends downward and away from the horizontal line C8 orthogonal to the axis C7 as the upper side surface 26*a* is away from the axis C7 of the rod 7. The upper side surface 26*a* of the cushion rubber 26 also extends obliquely downward from the vicinity of the rod 7. A projection 26*b* projecting from the upper side surface 26*a* is provided at the distal end of the cushion rubber 26. The projection 26*b* is substantially triangular in side view. The projection 26*b* is formed at a lowermost position on the upper side surface 26*a* of the cushion rubber 26.

As shown in FIGS. 2 and 3, the arm portion 22 extends vertically downward from the lever proximal end 21*a*. The hook portion 23 is substantially triangular in side view. The hook portion 23 is formed at the proximal end of the arm portion 22 with its distal end directed to the lever portion 21. The hook portion 23 has a flat engagement surface 23*a* that engages with the lower unit 40.

The upper unit 30 includes an upper unit body 31 inserted into the rod 7, a fixing bolt 33, and a nut member 34. The fixing bolt 33 and the nut member 34 are used for fixing the upper unit body 31 to the rod 7. The upper unit body 31 has a center hole 31*a* through which the rod 7 is inserted. In the upper unit body 31, an insertion hole 31*b* extending in the vertical direction is formed at a position shifted laterally from the axis of the center hole 31*a*. The axis of the insertion hole 31*b* is parallel to the axis of the center hole 31*a*. On the upper surface of the upper unit body 31, a cylindrical contact portion 35 as a contact portion is formed so as to surround the opening end of the insertion hole 31*b*.

Figure 4:
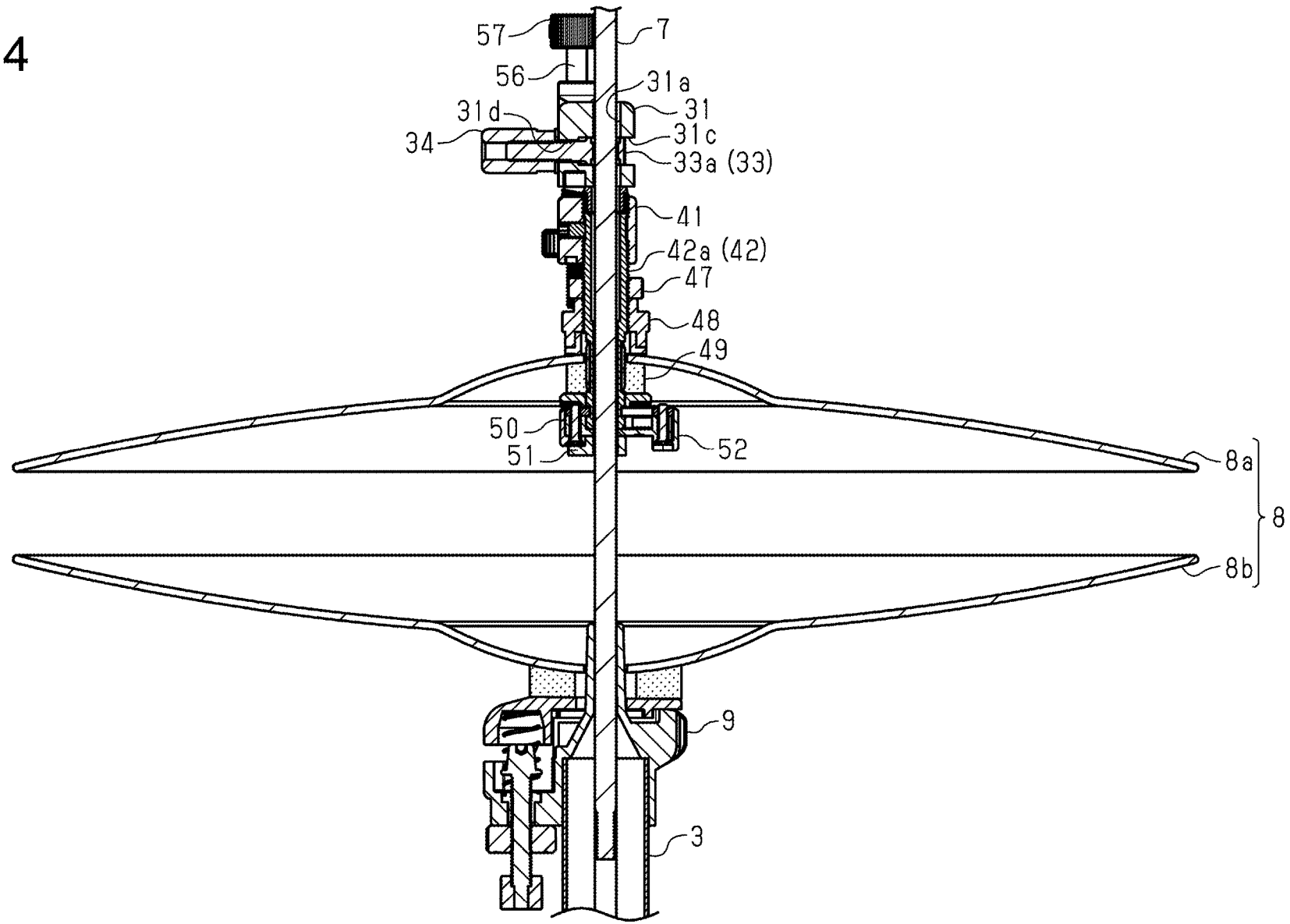
FIG. 4 is a partial cross-sectional view taken along line 4-4 of FIG. 1.

As shown in FIGS. 3 and 4, the upper unit body 31 has an accommodation space 31*c* in which a ring portion 33*a* of the fixing bolt 33 is accommodated, and an insertion hole 31*d* extending in the lateral direction from the accommodation space 31*c*. The fixing bolt 33 is accommodated in the accommodation space 31*c* of the upper unit body 31 with the ring portion 33*a* substantially coinciding with the center hole 31*a* and the distal end projecting from the insertion hole 31*d*. In this state, when tightening the nut member 34 screwed to the distal end of the fixing bolt 33, the rod 7 is pressed against the wall surface of the center hole 31*a* by the ring portion 33*a*, and the upper unit body 31 is fixed to the rod 7.

As shown in FIGS. 2 and 3, the lower portion of the upper unit body 31 has a regulation projection 36 for regulating the range of turn of the operation lever 20. The regulation projection 36 projects laterally from the upper unit body 31 and is formed at a position facing the lever proximal end 21*a* of the operation lever 20. As shown in the enlarged view of FIG. 7, the regulation projection 36 has a flat surface 36*a* that is disposed facing the lever proximal end 21*a*. The flat surface 36*a* is a slope face extending in substantially the same direction as the lever portion 21.

As shown in FIGS. 2 and 3, the lower unit 40 includes a lower unit body 41, a hollow bolt 42 screwed to the lower unit body 41, and a fixing screw 43 for fixing the hollow bolt 42 to the lower unit body 41. An engagement projection 44 that is engaged with the hook portion 23 of the operation lever 20 is formed on the upper part of the lower unit body 41. The engagement projection 44 projects laterally from the lower unit body 41. As shown in the enlarged view of FIG. 7, the engagement projection 44 has a inclined surface 44*a* that is disposed facing the arm portion 22 of the operation lever 20, a lower surface 44*b* in surface contact with the engagement surface 23*a* of the hook portion 23, and a contact surface 44*c* provided between the inclined surface 44*a* and the lower surface 44*b*.

As shown in FIGS. 2 and 3, a lower unit body 41 has a center screw hole 41*a* into which a hollow bolt 42 is screwed and a screw hole 41*c* into which a fixing screw 43 is screwed. The lower unit body 41 has a screw hole 41*b* extending in the vertical direction at a position laterally displaced from the axis of the center screw hole 41*a*. The axis of the screw hole 41*b* is parallel to the axis of the center screw hole 41*a*. The screw hole 41*b* of the lower unit body 41 is formed at a position corresponding to the insertion hole 31*b* of the upper unit body 31. In addition, a cylindrical support portion 45 is formed on the upper surface of the lower unit body 41 so as to surround the opening end of the screw hole 41*b*.

The hollow bolt 42 is formed of a cylindrical body extending in the vertical direction, and is formed such that the rod 7 is inserted into the cylindrical body. A cylindrical rubber cap 46 is attached to the upper end of the hollow bolt 42. With the hollow bolt 42 fixed to the lower unit body 41, the rubber cap 46 is disposed so as to be exposed from the upper opening end of the center screw hole 41*a* of the lower unit body 41. A central screw portion 42*a* of the hollow bolt 42 is screwed into a lock nut 47 and an adjustment nut 48. An annular groove 42*b* is formed on the outer peripheral surface at the lower end of the hollow bolt 42. A stopper assembly 50 is mounted near the lower end of the hollow bolt 42 which is inserted through a cylindrical felt 49.

The stopper assembly 50 includes a stopper holder 51 and a stopper slider 52. The stopper slider 52 is slidably accommodated in the stopper holder 51. The stopper assembly 50 is configured to be attached to and detached from the hollow bolt 42 by sliding the stopper slider 52 to engage and disengage with the annular groove 42*b*. As shown in FIG. 4, the top cymbal 8*a* is sandwiched between the felt 49 and the adjustment nut 48 by attaching the stopper assembly 50 to the hollow bolt 42.

As shown in FIGS. 2 and 3, the lower unit 40 includes a regulation unit 55 that regulates the maximum fall position of the lower unit 40. The regulation unit 55 includes a connection bolt 56 as a connection portion for connecting the upper unit 30 and the lower unit 40. The connection bolt 56 is inserted into the insertion hole 31*b* of the upper unit body 31, and is screwed into the screw hole 41*b* of the lower unit body 41. In this state, the connection bolt 56 has an axis parallel to that of the rod 7. In addition, the axis C56 of the connection bolt 56 is laterally shifted from the axis C7 of the rod 7.

A knob member 57 operated when turning the connection bolt 56 is fixed at the upper end of the connection bolt 56. The knob member 57 functions as a head of the connection bolt 56. A lock nut 58 operated when fixing the connection bolt 56 to the lower unit body 41 is screwed at the lower end of the connection bolt 56. The connection bolt 56 has a smooth outer peripheral surface 56*b* between the upper end of a screw portion 56*a* screwed to the lower unit body 41 and the knob member 57.

The regulation unit 55 is configured to regulate the maximum fall position of the lower unit 40 by bringing the knob member 57 of the connection bolt 56 into contact with the cylindrical contact portion 35 of the upper unit body 31. The regulation unit 55 includes a screw mechanism 59 including the connection bolt 56, the screw hole 41*b* of the lower unit body 41, and the lock nut 58. The regulation unit 55 is configured to adjust the maximum fall position of the lower unit 40 by adjusting the amount of screwing of the connection bolt 56 by the screw mechanism 59.

According to the hi-hat attachment 10, when the engagement between the operation lever 20 and the lower unit 40 is released, the lower unit 40 together with the top cymbal 8*a* falls from the initial position. The regulation unit 55 determines the amount of fall of the lower unit 40 and the top cymbal 8*a* according to the amount of screwing of the connection bolt 56, that is, the amount of protrusion of the connection bolt 56 projecting upward from the screw hole 41*b*. In particular, by turning the connection bolt 56 to the right and inserting the connection bolt 56 into the screw hole 41*b* of the lower unit body 41, the amount of protrusion of the connection bolt 56 from the screw hole 41*b* is reduced, and the amount of fall of the lower unit 40 is also reduced. On the other hand, by turning the connection bolt 56 to the left and pulling the connection bolt 56 out from the screw hole 41*b* of the lower unit body 41, the amount of protrusion of the connection bolt 56 from the screw hole 41*b* increases, the amount of fall of the lower unit 40 also increases.

Figure 5:
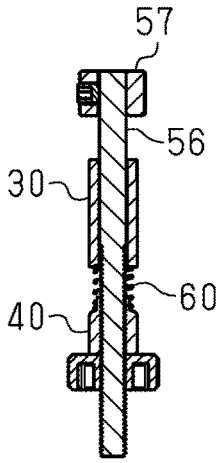
FIG. 5 is a partial cross-sectional view taken along line 5-5 of FIG. 1.
Figure 6:
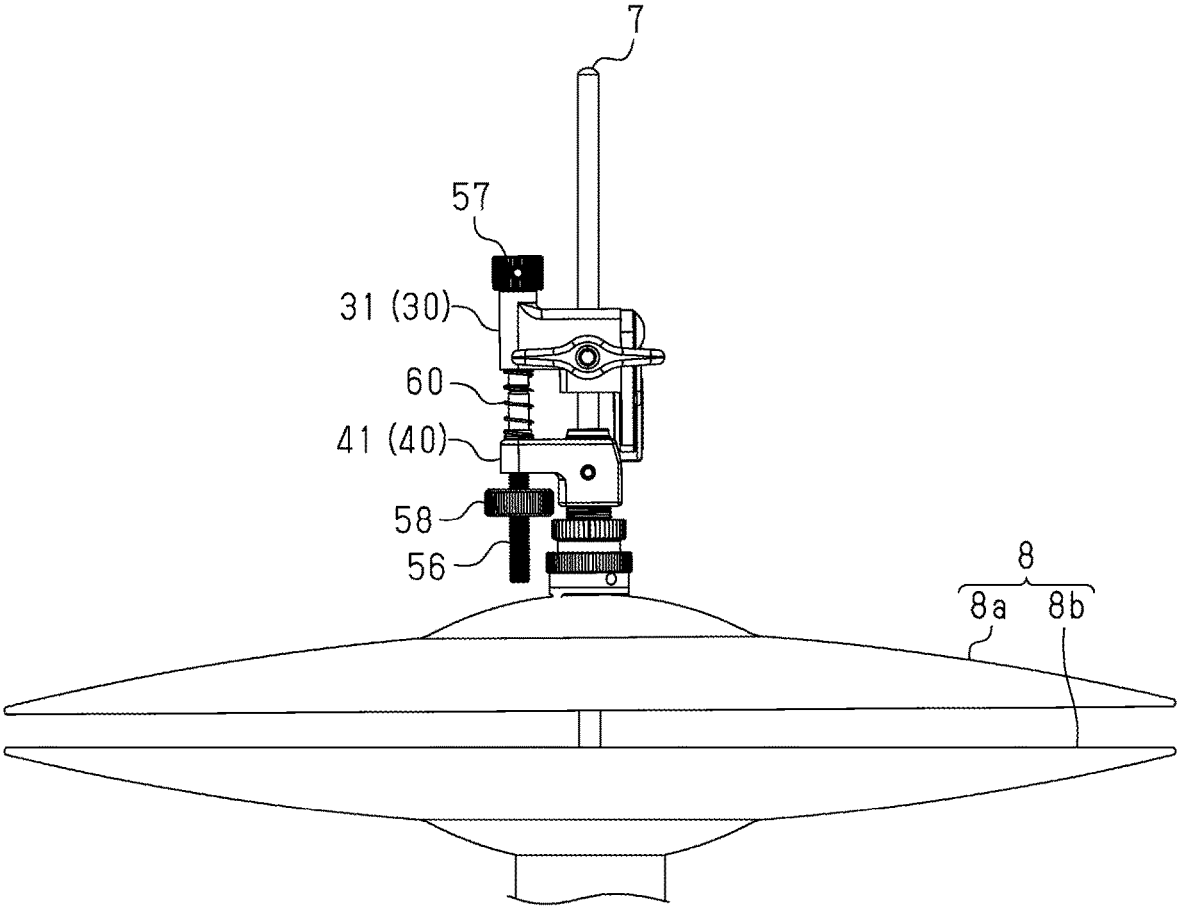
FIG. 6 is a partial side view showing the hi-hat in a half-open state.

As shown in FIGS. 5 and 6, a coil spring 60 as a spring is mounted on the outer periphery of the connection bolt 56. The coil spring 60 is mounted on the connection bolt 56 while being compressed between the upper unit body 31 and the lower unit body 41. Further, the coil spring 60 is compressed by the upper unit body 31 and the lower unit body 41, and constantly urges the lower unit 40 toward the top cymbal 8*a*.

Next, the operation of the hi-hat attachment 10 will be described with reference to FIGS. 7 to 9. Here, an operation procedure until the hi-hat 8 is switched from the open state to the half-open state will be described.

As shown in FIG. 7, when the hi-hat 8 is in an open state, the lower unit 40 is disposed at the initial position, so that the hook portion 23 of the operation lever 20 is engaged with the engagement projection 44 of the lower unit 40. At this time, the engagement surface 23*a* of the hook portion 23 is in surface contact with the lower surface 44*b* of the engagement projection 44. Thereby, the lower unit 40 is held at the initial position. The distal end of the arm portion 22 is in surface contact with the contact surface 44*c* of the engagement projection 44. Thereby, the counterclockwise turn of the operation lever 20 is regulated. Note that the maximum fall position of the lower unit 40, that is, the maximum fall position of the top cymbal 8*a* is adjusted in advance by turning the knob member 57 and adjusting the amount of screwing of the connection bolt 56.

Figure 8:
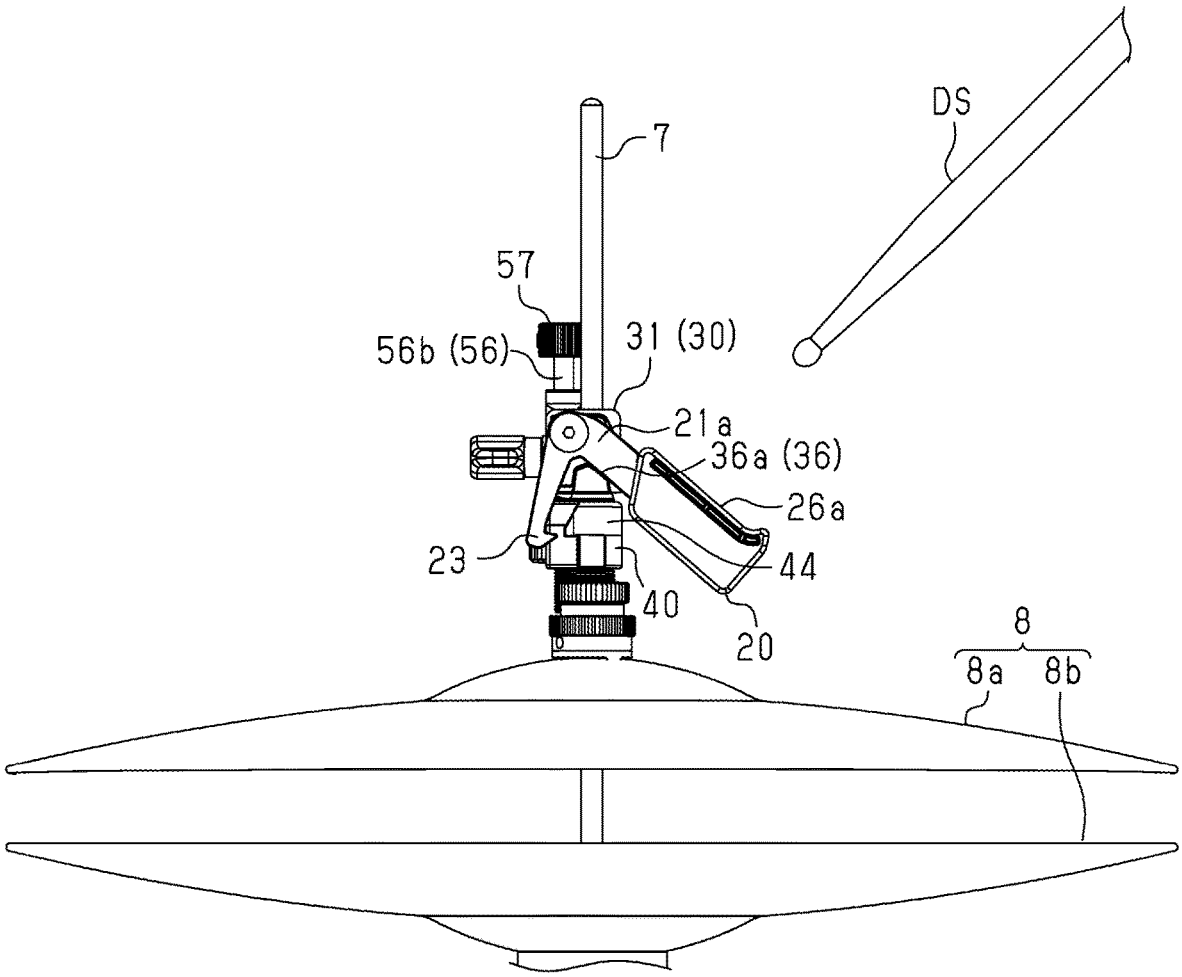
FIG. 8 is a partial cross-sectional view showing a state when the lower unit starts to fall.

As shown in FIG. 8, when the hi-hat 8 is switched from the open state to the half-open state, the upper side surface 26*a* of the operation lever 20 is hit from above by a drum stick DS. Then, the operation lever 20 turns clockwise, and the hook portion 23 of the operation lever 20 is disengaged from the engagement projection 44 of the lower unit 40. As a result, the engagement between the operation lever 20 and the lower unit 40 is released, so that the lower unit 40 starts to fall together with the top cymbal 8*a* from the initial position. At this time, even when the operation lever 20 is strongly hit by the drum stick DS, the lever proximal end 21*a* of the operation lever 20 is brought into contact with the flat surface 36*a* of the regulation projection 36 of the upper unit 30. Thereby, the clockwise turn of the operation lever 20 is regulated to the turn position shown in FIG. 8 at the maximum.

Figure 9:
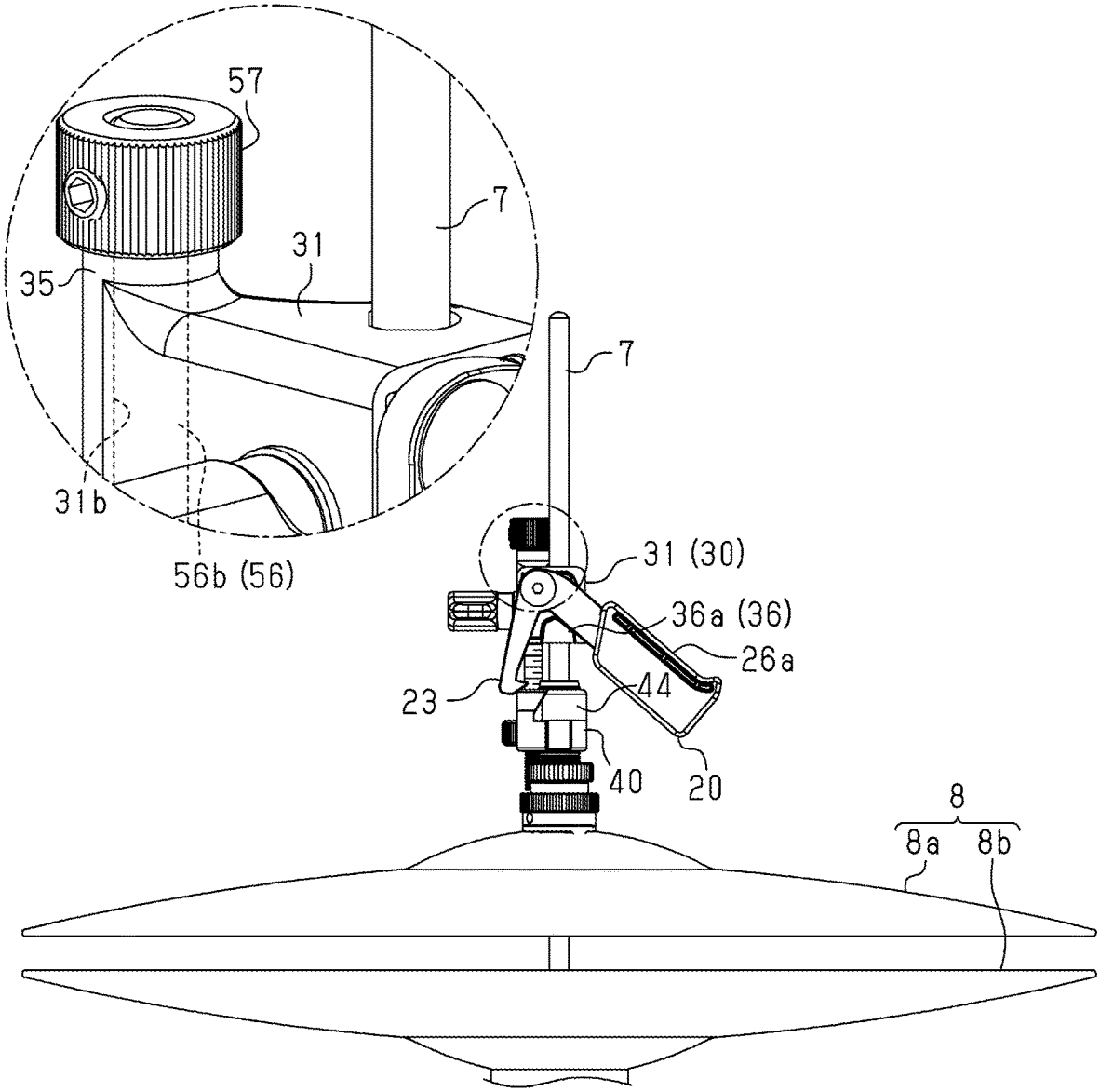
FIG. 9 is a partial cross-sectional view showing a state where the lower unit has fallen to the maximum fall position.

As shown in FIG. 9, when the engagement between the operation lever 20 and the lower unit 40 is released, the lower unit 40 falls from the initial position together with the top cymbal 8*a*. At this time, the lower unit 40 falls together with the top cymbal 8*a* while sliding the outer peripheral surface 56*b* of the connection bolt 56 against the inner peripheral surface of the insertion hole 31*b* of the upper unit body 31. Then, the knob member 57 of the connection bolt 56 is brought into contact with the cylindrical contact portion 35 of the upper unit body 31, so that the lower unit 40 and the top cymbal 8*a* stop falling at the intermediate position shown in FIG. 9. As a result, the hi-hat 8 is switched from the open state to the half-open state. Thereafter, in order to finely adjust the degree of the half-opening of the hi-hat, the maximum fall position of the lower unit 40 is finely adjusted by turning the knob member 57 and adjusting the amount of screwing of the connection bolt 56.

Therefore, according to the present embodiment, the following effects can be obtained.

(1) The hi-hat attachment 10 includes the upper unit 30, the lower unit 40, and the operation lever 20. The lower unit 40 includes the regulation unit 55 that regulates the maximum fall position of the lower unit 40. According to this configuration, the hi-hat 8 can be brought into a half-open state by regulating the maximum fall position of the lower unit 40 by the regulation unit 55. In this case, it is possible to realize a configuration in which the hi-hat 8 is set to the half-open state only by adding a configuration that regulates the fall position of the lower unit 40. Thus, the hi-hat 8 can be switched from the open state to the half-open state with a simple configuration. Further, the lower unit 40 can be fallen to the maximum fall position only by operating the operation lever 20 to release the engagement between the operation lever 20 and the lower unit 40. Therefore, the hi-hat 8 can be switched from the open state to the half-open state by a simple operation.

(2) The regulation unit 55 is configured to adjust the maximum fall position of the lower unit 40. According to this configuration, the maximum fall position of the top cymbal 8*a* can be adjusted by adjusting the maximum fall position of the lower unit 40 by the regulation unit 55. In this case, the maximum fall position of the top cymbal 8*a* can be adjusted from the half-open state to the closed state of the hi-hat 8. Thereby, the tone and sound when the hi-hat 8 is half-opened can be finely tuned. Therefore, it becomes easy to increase the variation of the tone and the sound of the hi-hat 8.

(3) The regulation unit 55 is configured to adjust the maximum fall position of the lower unit 40 by adjusting the amount of screwing of the connection bolt 56 by the screw mechanism 59. According to this configuration, the maximum fall position of the lower unit 40 can be continuously adjusted by the screw mechanism 59, and the maximum fall position of the top cymbal 8*a* can be continuously adjusted. This makes it easy to fine-tune the tone and sound when the hi-hat 8 is half-opened.

(4) The connection bolt 56 is inserted into the insertion hole 31*b* of the upper unit body 31, and is screwed into the screw hole 41*b* of the lower unit body 41. The regulation unit 55 is configured to regulate the maximum fall position of the lower unit 40 by bringing the knob member 57 of the connection bolt 56 into contact with the cylindrical contact portion 35 of the upper unit body 31. According to this configuration, the regulation unit 55 can be formed of the upper unit body 31 and the connection bolt 56 screwed into the screw hole 41*b* of the lower unit body 41. As a result, the number of components to be added can be reduced in comparison with the case where the regulation unit 55 is formed of a member different from any the upper unit body 31, the lower unit body 41, and the connection bolt 56.

(5) The regulation unit 55 includes the connection bolt 56 as a connection portion for connecting the upper unit 30 and the lower unit 40. According to this configuration, since the upper unit 30 and the lower unit 40 are connected via the connection bolt 56, the upper unit 30 and the lower unit 40 do not separate even when removing the hi-hat attachment 10 from the hi-hat stand 1. Therefore, handling of the hi-hat attachment 10 becomes easy.

(6) The connection bolt 56 is inserted into the insertion hole 31*b* of the upper unit body 31, and is screwed into the screw hole 41*b* of the lower unit body 41. In this state, the connection bolt 56 has an axis parallel to that of the rod 7. In addition, the axis of the connection bolt 56 is laterally shifted from the axis of the rod 7. According to this configuration, the connection structure between the upper unit 30 and the lower unit 40 can be formed without the main components of the upper unit 30 and the lower unit 40 involved. In this case, the vertical dimension of the hi-hat attachment 10 can be made compact compared with the configuration in which the connection structure is formed coaxially with respective main components of the upper unit 30 and the lower unit 40.

(7) The regulation unit 55 is configured to regulate the maximum fall position of the lower unit 40 by bringing the knob member 57 of the connection bolt 56 into contact with the cylindrical contact portion 35 of the upper unit body 31. In addition, the regulation unit 55 is configured to adjust the maximum fall position of the lower unit 40 by adjusting the amount of screwing of the connection bolt 56 by the screw mechanism 59. According to this configuration, it is possible to realize a configuration in which the maximum fall position of the lower unit 40 is regulated and a configuration in which the maximum fall position of the lower unit 40 is adjusted only by adding the connection bolt 56. Therefore, the number of components to be added can be reduced, and the configuration of the entire hi-hat attachment 10 can be simplified. Further, by adjusting the amount of screwing of the connection bolt 56, the maximum fall position of the lower unit 40 can be continuously adjusted, and the maximum fall position of the top cymbal 8*a* can be continuously adjusted.

(8) The connection bolt 56 has a smooth outer peripheral surface 56*b* between the upper end of the screw portion 56*a* screwed to the lower unit body 41 and the knob member 57. According to this configuration, when the engagement between the operation lever 20 and the lower unit 40 is released, the lower unit 40 can be fallen while sliding the outer peripheral surface of the connection bolt 56 against the inner peripheral surface of the insertion hole 31*b* of the upper unit body 31. In this case, since the outer peripheral surface of the connection bolt 56 is a smooth surface, the lower unit 40 can be fallen smoothly. Therefore, the hi-hat 8 can be smoothly switched from the open state to the half-open state or the closed state.

(9) The coil spring 60 is mounted on the connection bolt 56 while being compressed between the upper unit body 31 and the lower unit body 41. The coil spring 60 is compressed by the upper unit body 31 and the lower unit body 41, so that the lower unit 40 is constantly biased toward the top cymbal 8*a* with the operation lever 20 and the lower unit 40 disengaged from each other. According to this configuration, even when the top cymbal 8*a* is hit and shakes greatly, the state where the engagement between the operation lever 20 and the lower unit 40 is released can be maintained by the urging force of the coil spring 60. Therefore, unless the pedal 6 of the hi-hat stand 1 is operated, the lower unit 40 becomes difficult to lift together with the top cymbal 8*a*. Therefore, it is difficult to switch the hi-hat 8 from the closed state to the open state against the user's intention.

(10) In the hi-hat stand 1, the lower end of the rod 7 is screwed into a female screw portion connected to the distal end of the pedal 6. For this reason, the rod 7 is fixed to the distal end of the pedal 6 by being tightened to the female screw portion. When the hi-hat 8 is attached to the hi-hat stand 1 using the hi-hat attachment 10, the hi-hat attachment 10 is disposed above the hi-hat 8. In this case, although it is easy to swing the drum stick DS up and down when hitting hi-hat 8 with the drum stick DS, it becomes difficult to swing the drum stick DS up and down when operating the operation lever 20 of the hi-hat attachment 10. For this reason, the player sometimes operates the operation lever 20 of the hi-hat attachment 10 by raising the drum stick DS and pushing it forward. In this case, when the operation lever 20 is set on the right side of the rod 7, a counterclockwise force easily acts on the rod 7 via the operation lever 20. For this reason, when the operation of the operation lever 20 is repeated, the rod 7 is easily loosened with respect to the female screw portion, and it is not possible to maintain the operation lever 20 at the initial setting position.

In this regard, according to the present embodiment, the upper side surface 26*a* of the cushion rubber 26 is used as a hitting surface that is hit by the drum stick DS. The upper side surface 26*a* of the cushion rubber 26 extends downward and away from the horizontal line C8 orthogonal to the axis C7 of the rod 7 as the upper side surface 26*a* is away from the axis C7 of the rod 7. That is, the upper side surface 26*a* of the cushion rubber 26 extends obliquely downward from the vicinity of the rod 7. Therefore, the upper side surface 26*a* of the cushion rubber 26 can be closer to the top cymbal 8*a* than the operation lever extending in the horizontal direction from the vicinity of the rod 7. This makes it easier for the player to swing the drum stick DS up and down when operating the operation lever 20 of the hi-hat attachment 10. Therefore, when the operation lever 20 is set on the right side of the rod 7, a counterclockwise force is less likely to act on the rod 7 via the operation lever 20. Further, in this case, since the horizontal distance of the operation lever 20 is reduced, the torque acting on the rod 7 via the operation lever 20 is also suppressed. Therefore, even when the operation lever 20 is repeatedly hit, the rod 7 is unlikely to be loosened with respect to the female screw portion, so that it is easy to maintain the operation lever 20 at the initial setting position.

(11) The player often hits the distal end of the operation lever 20 with the drum stick DS to switch the hi-hat 8 from the open state to the half-open state. For this reason, when the upper side surface 26*a* of the cushion rubber 26 extends obliquely downward, it is easy for the drum stick DS to go downward after passing through the distal end of the operation lever 20 after hitting the operation lever 20 with the drum stick DS. For this reason, the drum stick DS may touch the top cymbal 8*a* or hit the top cymbal 8*a* by mistake. In this regard, according to the present embodiment, the distal end of the cushion rubber 26 is provided with the projection

26*b* projecting from the upper side surface 26*a*. In this way, by providing the projection 26*b* at the distal end of the operation lever 20, the drum stick DS can be prevented from going below the distal end of the operation lever 20. Therefore, it is possible to prevent the drum stick DS from touching the top cymbal 8*a* or hitting the top cymbal 8*a* by mistake during the performance.

The embodiment may be modified as follows.

Figure 10:
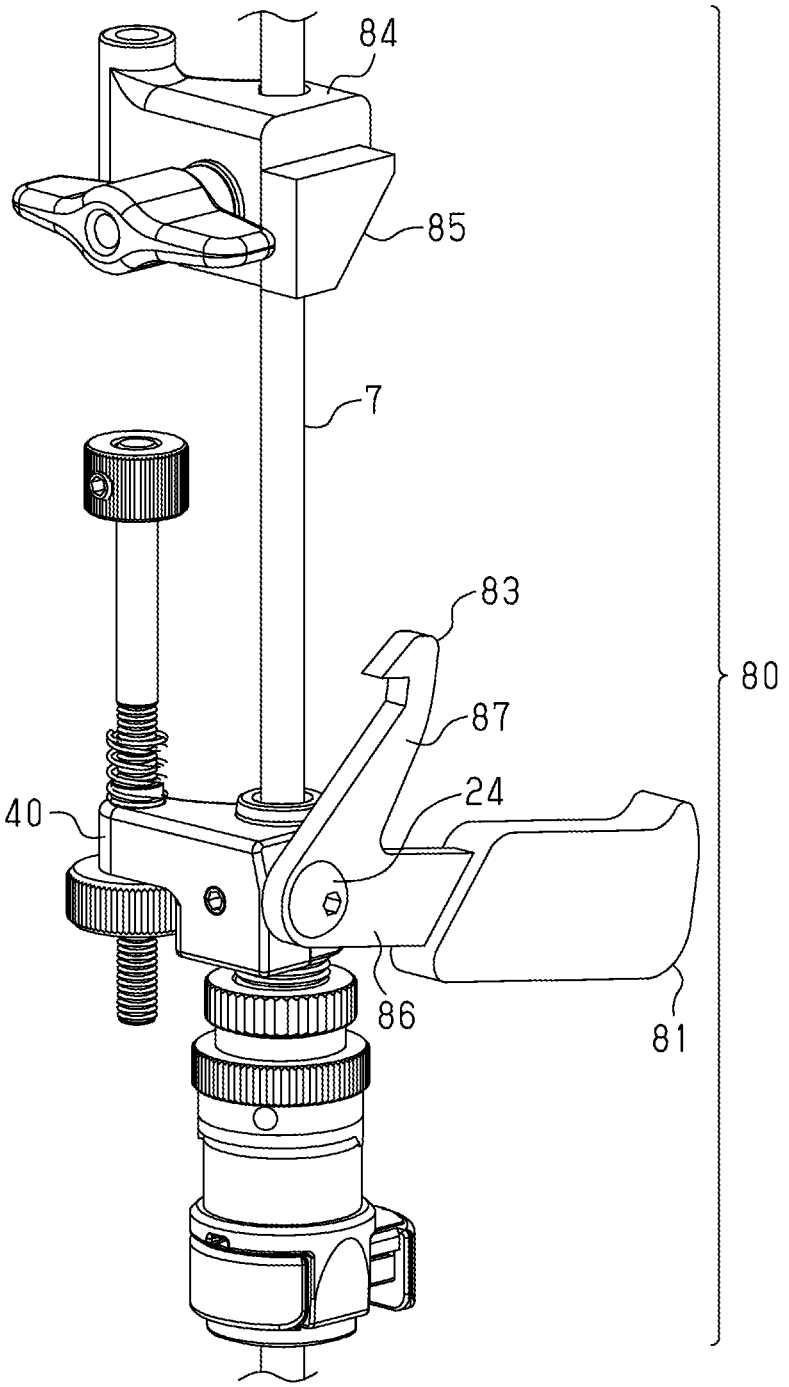
FIG. 10 is a perspective view showing the overall configuration of another example of the hi-hat attachment.

The operation lever 20 may be provided on the lower unit 40 instead of the upper unit 30. For example, as shown in FIG. 10, an operation lever 81 may be attached to the lower unit 40 from the side with the mounting screw 24. In this case, a hi-hat attachment 80 is configured such that when hitting the operation lever 81 from above using a drum stick or the like, the operation lever 81 turns clockwise, and a hook portion 83 of the operation lever 81 is disengaged from an engagement projection 85 of an upper unit 84. The hook portion 83 is formed at the distal end of an arm portion 87 with the distal end opposite to a lever portion 86. The engagement projection 85 has a shape in which the engagement projection 44 shown in FIG. 2 is turned upside down.

The regulation unit 55 may have only a function of regulating the maximum fall position of the lower unit 40. In other words, the function of adjusting the maximum fall position by the screw mechanism 59 may be omitted from the regulation unit 55.

Figure 11:
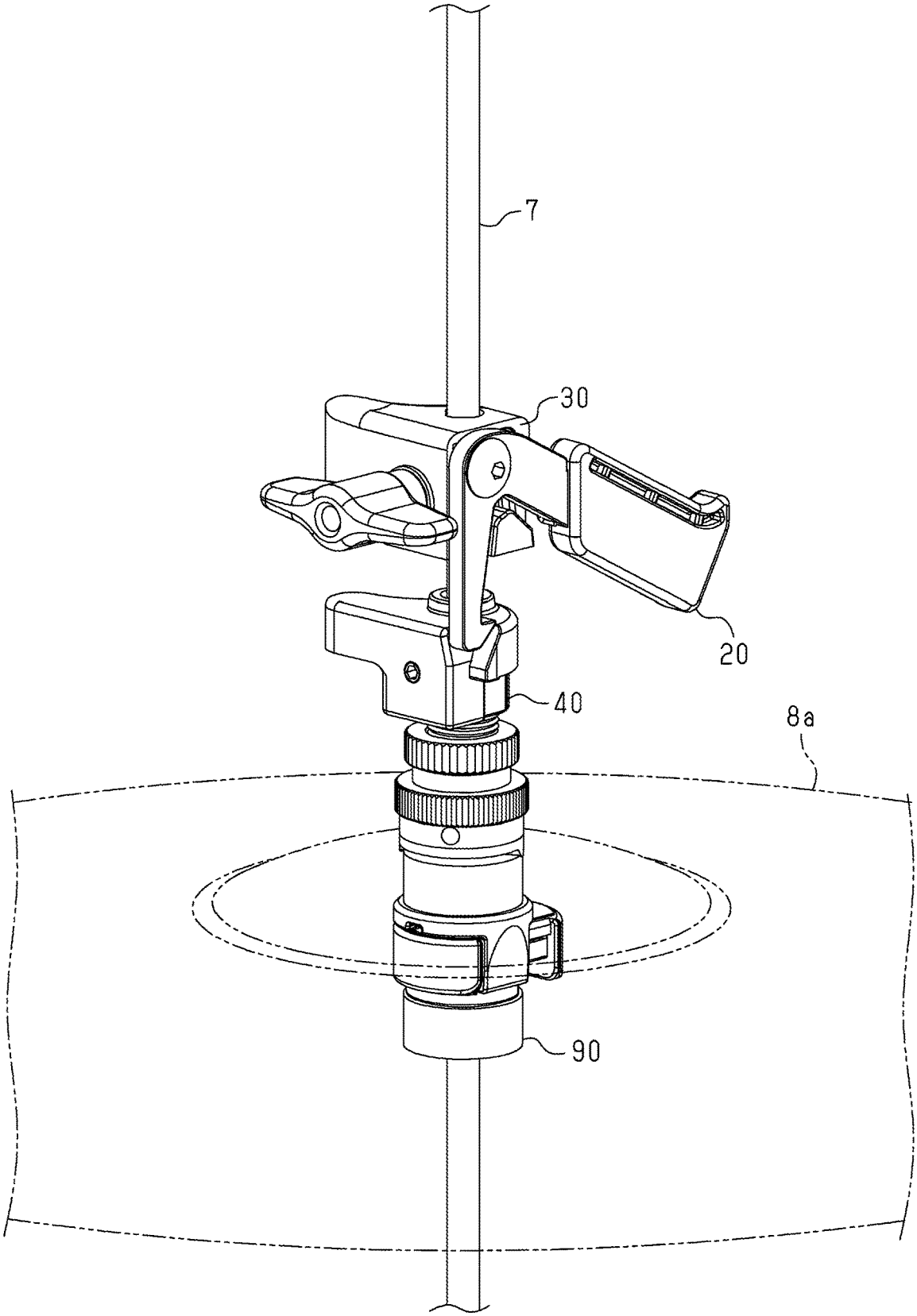
FIG. 11 is a perspective view showing the overall configuration of another example of the hi-hat attachment.

The regulation unit 55 may be a member different from any of the upper unit 30 and the lower unit 40, for example, as shown in FIG. 11, the regulation unit may be a fixture 90 fixed to the rod 7 of the hi-hat stand 1. According to this configuration, when the operation lever 20 is operated to release the engagement between the operation lever 20 and the lower unit 40, the lower unit 40 can be fallen to the maximum fall position with the fixture 90.

Figure 12A:
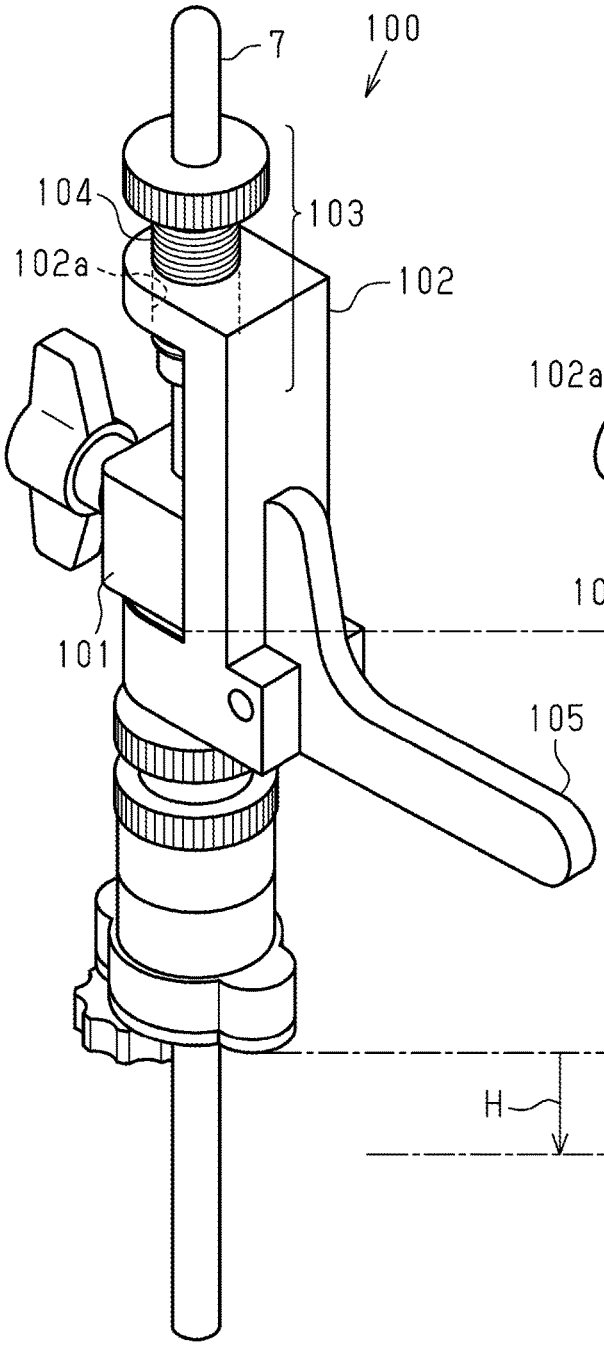
FIG. 12A is a perspective view showing the overall configuration of another example of the hi-hat attachment.
Figure 12B:
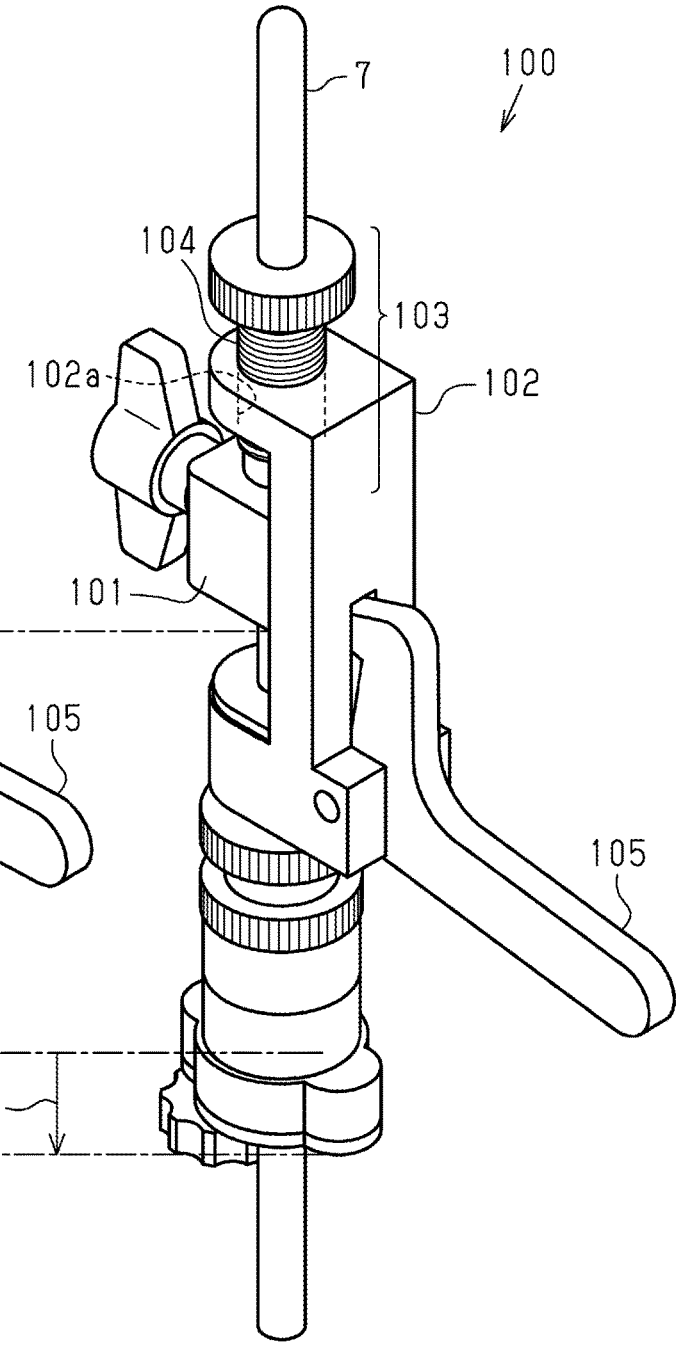
FIG. 12B is a perspective view showing the overall configuration of another example of the hi-hat attachment.

Although the screw mechanism 59 is laterally shifted from the axis of the rod 7 in order to adjust the maximum fall position of the lower unit 40 that functions as a cymbal holding portion, it may be disposed coaxially with the axis of the rod 7. For example, as shown in FIGS. 12A and 12B, a hi-hat attachment 100 includes a fixture 101 fixed to the rod 7 of the hi-hat stand and an attachment body 102 slidably supported on the rod 7. A screw mechanism 103 disposed coaxially with the axis of the rod 7 is provided on an upper portion of the attachment body 102. The screw mechanism 103 includes a screw hole 102*a* formed at an upper portion of the attachment body 102 and a bolt 104 screwed into the screw hole 102*a*. According to this configuration, when the engagement between an operation lever 105 and the fixture 101 is released, the attachment body 102 falls together with a top cymbal (not shown) from the initial position shown in FIG. 12A to the maximum fall position shown in FIG. 12B. The screw mechanism 103 as the regulation unit determines the amount of fall H of the attachment body 102 and the top cymbal according to the amount of screwing of the bolt 104, that is, the amount of protrusion of the bolt 104 projecting downward from the screw hole 102*a*. In this case, the larger the amount of protrusion of the bolt 104 from the screw hole 102*a*, the smaller the amount of fall of the attachment body 102.

The connection portion may not be the connection bolt 56. That is, the connection portion may be a shaft extending upward from the lower unit 40 and having a head at the upper end. In this case, the head of the shaft may be brought into contact with the cylindrical contact portion 35 of the upper unit body 31 to regulate the maximum fall position of the lower unit 40. In addition, as described above, the configuration in which the maximum fall position of the lower unit 40 from the hi-hat attachment 10 can be adjusted may be omitted by changing the connection bolt 56 to a shaft.

The outer peripheral surface of the connection bolt 56 may not be a smooth surface, but, for example, may be a surface on which a vertical groove extending along the axis of the connection bolt may be formed.

The coil spring 60 mounted on the outer periphery of the connection bolt 56 may be omitted.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A hi-hat attachment for attaching a hi-hat to a hi-hat stand, the hi-hat including a top cymbal, and a bottom cymbal, the hi-hat stand including a pedal operated during a performance of the hi-hat, and a rod that moves up and down by a depression of the pedal, the hi-hat attachment comprising:

a fixed portion configured to be fixed to the rod;

a cymbal holding portion configured to be slidably supported on the rod, the cymbal holding portion being configured to hold the top cymbal below the fixed portion; and an operation lever provided on one of the fixed portion and the cymbal holding portion, the operation lever being configured to be engageable with the other of the fixed portion and the cymbal holding portion, wherein while the cymbal holding portion is disposed at an initial position and the hi-hat is in an open state when the operation lever and the fixed portion or the cymbal holding portion are engaged, the cymbal holding portion falls when an engagement between the operation lever and the fixed portion or the cymbal holding portion is released, and the hi-hat attachment further comprising:

a regulation unit configured to adjust a maximum fall position of the cymbal holding portion relative to the fixed portion, wherein the regulation unit includes a screw mechanism, and the regulation unit is configured to adjust the maximum fall position of the cymbal holding portion by the screw mechanism.

2. The hi-hat attachment according to claim 1, wherein the regulation unit is provided on one of the fixed portion and the cymbal holding portion, and the regulation unit is configured to regulate the maximum fall position of the cymbal holding portion by bringing one of the fixed portion and the cymbal holding portion into contact with the other of the fixed portion and the cymbal holding portion.

3. The hi-hat attachment according to claim 2, wherein the regulation unit includes a connection portion that connects the fixed portion and the cymbal holding portion.

4. The hi-hat attachment according to claim 3, wherein the connection portion has an axis parallel to an axis of the rod, and the axis of the connection portion is laterally shifted from the axis of the rod.

5. The hi-hat attachment according to claim 3, wherein the connection portion is formed of a connection bolt screwed to the cymbal holding portion, and the connection portion is configured to regulate the maximum fall position of the cymbal holding portion by bringing a head of the connection bolt into contact with the fixed portion, and adjust the maximum fall position of the cymbal holding portion by adjusting an amount of screwing of the connection bolt.

6. The hi-hat attachment according to claim 5, wherein the connection bolt has a smooth outer peripheral surface between a portion screwed to the cymbal holding portion and the head.

7. The hi-hat attachment according to claim 1, wherein the regulation unit further includes a spring disposed between the cymbal holding portion and the fixed portion, and the spring is configured to bias the cymbal holding portion toward the top cymbal.

* * * * *